US011350510B2

(12) United States Patent
Feng et al.

(10) Patent No.: US 11,350,510 B2
(45) Date of Patent: May 31, 2022

(54) MULTI-CHANNEL CONTROL METHOD FOR LIGHT STRIP

(71) Applicant: CONSUMER LIGHTING (U.S.), LLC, Norwalk, CT (US)

(72) Inventors: Can Feng, Shanghai (CN); Zhichao Liu, Shanghai (CN); Dong Xing, Shanghai (CN)

(73) Assignee: SAVANT TECHNOLOGIES LLC, Norwalk, CT (US)

( * ) Notice: Subject to any disclaimer, the term of this patent is extended or adjusted under 35 U.S.C. 154(b) by 46 days.

(21) Appl. No.: 16/906,869

(22) Filed: Jun. 19, 2020

(65) Prior Publication Data

US 2020/0404766 A1 Dec. 24, 2020

(30) Foreign Application Priority Data

Jun. 20, 2019 (CN) ..... 201910534871.4

(51) Int. Cl.
*H05B 47/185* (2020.01)
*H05B 47/19* (2020.01)
*H05B 45/37* (2020.01)

(52) U.S. Cl.
CPC ..... *H05B 47/185* (2020.01); *H05B 45/37* (2020.01); *H05B 47/19* (2020.01)

(58) Field of Classification Search
CPC .... H05B 47/19; H05B 45/10; H05B 41/2828; H05B 45/3725; H05B 45/375; H05B 45/38; H05B 45/20; H05B 45/325; H05B 47/195; H05B 47/16; H05B 45/357; H05B 45/37; H05B 45/00; H05B 47/105; H05B 45/395; H05B 47/115; H05B 47/11; H05B 47/125; H05B 47/24; H05B 45/385; H05B 45/36; H05B 45/345; H05B 47/10; H05B 45/3578; H05B 45/34; H05B 45/12; H05B 47/28; H05B 47/185; H05B 45/50; H05B 47/26; H05B 45/24; H05B 47/175; H05B 45/355; H05B 45/382; H05B 45/56; H05B 47/13; H05B 45/39; H05B 47/17; H05B 47/18; H05B 45/60; H05B 47/155; H05B 45/44; H05B 45/46; H05B 47/20; H05B 33/08; H05B 45/22; H05B 2203/036; H05B 3/34; H05B 3/342; H05B 35/00; H05B 41/2827;

(Continued)

(56) References Cited

U.S. PATENT DOCUMENTS

2012/0217882 A1* 8/2012 Wong ..... F21V 14/04 315/185 R
2017/0321849 A1* 11/2017 Xiong ..... H05B 45/375
2020/0349880 A1* 11/2020 Watson ..... H04R 1/028

FOREIGN PATENT DOCUMENTS

WO WO-2020157149 A1 * 8/2020 ..... H01L 33/24

* cited by examiner

*Primary Examiner* — Monica C King
(74) *Attorney, Agent, or Firm* — Wood IP LLC

(57) ABSTRACT

An electronic assembly with multi-channel outputs may include a controller and a driver. The controller may be configured to gate m channels of outputs thereof. The driver may be configured to provide n channels of modulated signal to the controller via n wires. The n is less than m. A lighting device using the electronic assembly may further include a plurality of lighting units. The driver may include a wireless communication module to receive control signal, and the driver is configured to modulate the input DC signal based on the control signal. The n wires may be aligned along a width direction of the substrate at the end of the substrate.

25 Claims, 7 Drawing Sheets

(58) Field of Classification Search
CPC ..... H05B 41/3927; H05B 45/18; H05B 45/3574; H05B 45/48; H05B 47/12; H05B 47/25; H05B 39/09; H05B 41/14; H05B 41/28; H05B 41/2853; H05B 45/28; H05B 45/31; H05B 45/32; H05B 45/397; H05B 45/40; H05B 47/00; H05B 47/14; H05B 47/29
See application file for complete search history.

| Input Voltage (1 wire) | Output Gating Signals | | |
|---|---|---|---|
| | Channel 1 | Channel 2 | Channel 3 |
| 1-2V | 1 | 0 | 0 |
| 2-3V | 0 | 1 | 0 |
| 3-4V | 0 | 0 | 1 |

| Input Voltage (2 wires) | | Output Gating Signals | | | | |
|---|---|---|---|---|---|---|
| | | Channel 1 | Channel 2 | Channel 3 | Channel 4 | Channel 5 |
| wire 1 | 1-2V | 1 | 0 | 0 | 0 | 0 |
| | 2-3V | 0 | 1 | 0 | 0 | 0 |
| | 3-4V | 0 | 0 | 1 | 0 | 0 |
| wire 2 | 1-2V | 0 | 0 | 0 | 1 | 0 |
| | 2-3V | 0 | 0 | 0 | 0 | 1 |

*FIG.4*

| Input Voltage (1 wire) | Input Current (1 wire) | Output Gating Signals | | | | | |
|---|---|---|---|---|---|---|---|
| | | Channel 1 | Channel 2 | Channel 3 | Channel 4 | Channel 5 | Channel 6 |
| 1-2V | 0.5-1A | 1 | 0 | 0 | 0 | 0 | 0 |
| 1-2V | 1-1.5A | 0 | 1 | 0 | 0 | 0 | 0 |
| 2-3V | 0.5-1A | 0 | 0 | 1 | 0 | 0 | 0 |
| 2-3V | 1-1.5A | 0 | 0 | 0 | 1 | 0 | 0 |
| 3-4V | 0.5-1A | 0 | 0 | 0 | 0 | 1 | 0 |
| 3-4V | 1-1.5A | 0 | 0 | 0 | 0 | 0 | 1 |

*FIG.5*

| Input | | Output | | | |
|---|---|---|---|---|---|
| i1 | i0 | D4 | D3 | D2 | D1 |
| 0 | 0 | 0 | 0 | 0 | 1 |
| 0 | 1 | 0 | 0 | 1 | 0 |
| 1 | 0 | 0 | 1 | 0 | 0 |
| 1 | 1 | 1 | 0 | 0 | 0 |

MULTI-CHANNEL CONTROL METHOD FOR LIGHT STRIP

FIELD

The present techniques relate generally to electronic assembly. More specifically, the present techniques relate generally to electronic assembly with multi-channel outputs.

BACKGROUND

In applications where a plurality of loads are divided into multiple channels for separate driving, a number of drive wires no less than the output channels are typically needed to provide drive signal respectively. For example, in an LED strip product, one or more LEDs are connected in series, in parallel, or both on each channel. Different illumination modes, such as blinking or various illumination patterns, are implemented by providing individual control signal for each channel by the driver.

However, such products are generally compact in structure, since the drive wire has a certain width, it is difficult to connect more drive wires along a limited width, and the number of output channels is thus greatly limited. In order to control more channels to achieve various complex controlling, it is necessary to increase the size (for example, width) of the entire product to allow more drive wires.

SUMMARY

The present disclosure provides an electrical assemble with multi-channel outputs being capable of controlling more channels of output without increasing the number of drive wires.

One aspect of the disclosure is an electronic assembly with multi-channel outputs. The electronic assembly may include a controller and a driver. The controller may be configured to gate m channels of outputs thereof. The driver may be configured to provide n channels of modulated signal to the controller via n wires. The n is less than m.

Another aspect of the disclosure is a lighting device. The lighting device may include a substrate, a controller and a plurality of lighting units. The controller may be mounted on one end of the substrate and includes m channels of outputs. The driver may be configured to provide n channels of modulated signal to the controller via n wires. The driver may include a communication module. The communication module may be configured to receive control signal. The driver may be configured to generate the n channels of modulated signal based on the control signal. The plurality of lighting units may be coupled to the m channels of outputs of the controller. The n is less than m. The n wires may be aligned along a width direction of the substrate at the end of the substrate. The controller may be configured to gate the m channels of outputs based on a correspondence between the at least one of the characteristics of the n channels of modulated signal and m channels of output signal. The characteristics may be selected from a group consists of voltage, current and a combination thereof.

Yet another aspect of the disclosure is a lighting device. The lighting device may include a substrate, a controller and a plurality of lighting units. The controller may be mounted on one end of the substrate and includes m channels of outputs. The driver may be configured to provide n channels of modulated signal to the controller via n wires. The driver may include a communication module. The communication module may be configured to receive control signal. The driver may be configured to generate the n channels of modulated signal based on the control signal. The plurality of lighting units may be coupled to the m channels of outputs of the controller. The controller may further comprise at least one decoder to gate the m channels of outputs based on the n channels of modulated signal. The n is less than m. The n wires may be aligned along a width direction of the substrate at the end of the substrate.

BRIEF DESCRIPTION OF THE DRAWINGS

The present disclosure can be better understood in light of description of embodiments of the present disclosure with reference to the accompanying drawings, in which:

FIG. 4 shows an example map between the voltage of input signal and output gating signal of the controller in the electronic assembly, in accordance with another embodiment.

FIG. 5 shows an example map between a combination of the current and voltage of input signal and output gating signal, in accordance with another embodiment.

DETAILED DESCRIPTION

Figure 1:
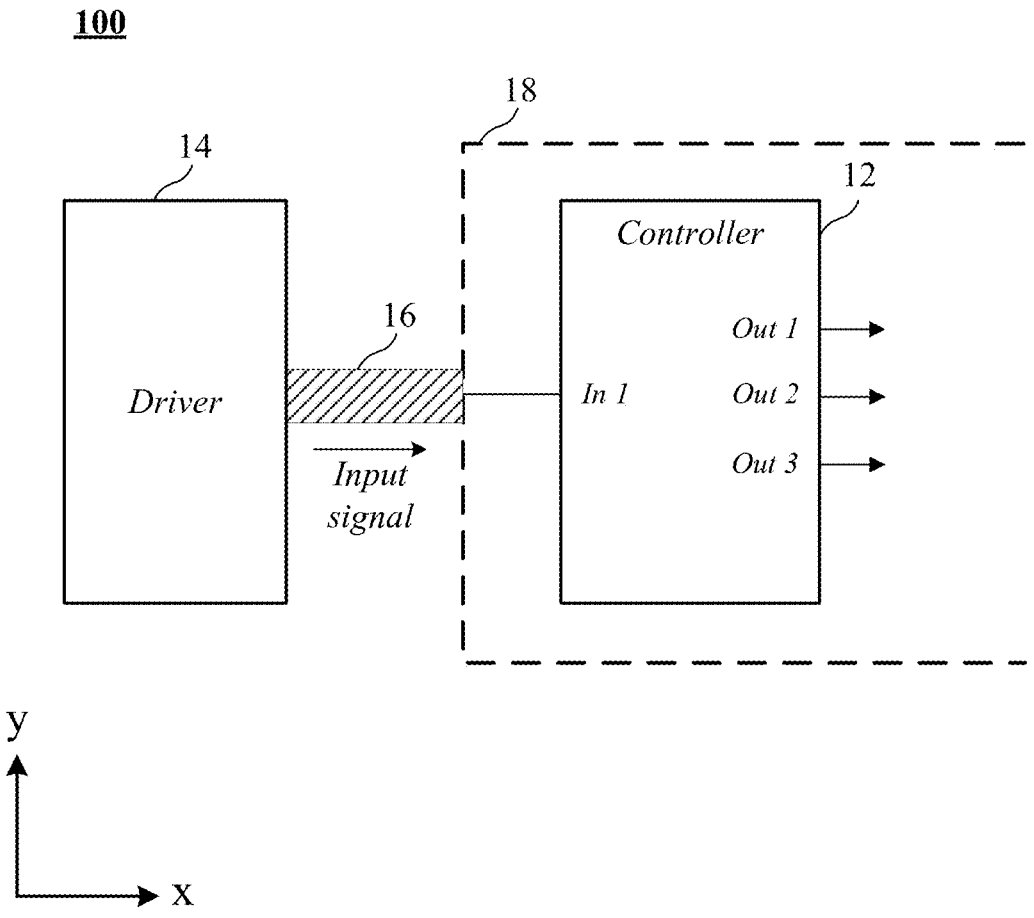
FIG. 1 is a schematic diagram of an example electronic assembly, in accordance with an embodiment.

Unless defined otherwise, the technical or scientific terms used herein should have the same meanings as commonly understood by one of ordinary skilled in the art to which the present disclosure belongs. The terms "first", "second" and the like in the Description and the Claims of the present application for disclosure do not mean any sequential order, number or importance, but are only used for distinguishing different components. Likewise, the terms "a", "an" and the like do not denote a limitation of quantity, but denote the existence of at least one. The terms "comprises", "comprising", "includes", "including" and the like mean that the element or object in front of the "comprises", "comprising", "includes" and "including" covers the elements or objects and their equivalents illustrated following the "comprises", "comprising", "includes" and "including", but do not exclude other elements or objects. The terms "coupled", "connected" and the like are not limited to being connected physically or mechanically, but may comprise electric connection, no matter directly or indirectly.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

Exemplary Electronic Assemblies

FIG. 1 is a schematic diagram of an example electronic assembly 100, in accordance with an embodiment.

The electronic assembly 100 includes a controller 12 and a driver 14. The driver 14 is connected to the controller 12 via a drive wire 16 to provide modulated input signal. The controller 12 has three channels of outputs. Each channel of the outputs may be coupled to one or more loads in series, in parallel, or both. Load may be lighting unit such as LED, sound output component, or the like.

Term "modulated" or "modulation" used herein refers to changing the voltage and/or current of a signal over time series.

The controller 12 may be mounted e.g. by soldering or fixed on a substrate 18 to gate the three channels of outputs based on the input signal. In some embodiments, the controller 12 may be mounted on one end (e.g. in x (length) direction) of the substrate 18. The substrate 18 may be a strip, such as flexible circuit board having a strip shape, such that the substrate 18 may be folded or bent into any shape. In some embodiments, the substrate 18 may be a printed circuit board. The drive wire 16 has a width less than the substrate 18. Here, drive wire refers to a physical wire component, which may include an insulating layer, a protective layer, etc. in addition to conductive portion and thus has a non-negligible width.

Figures 2, 3:
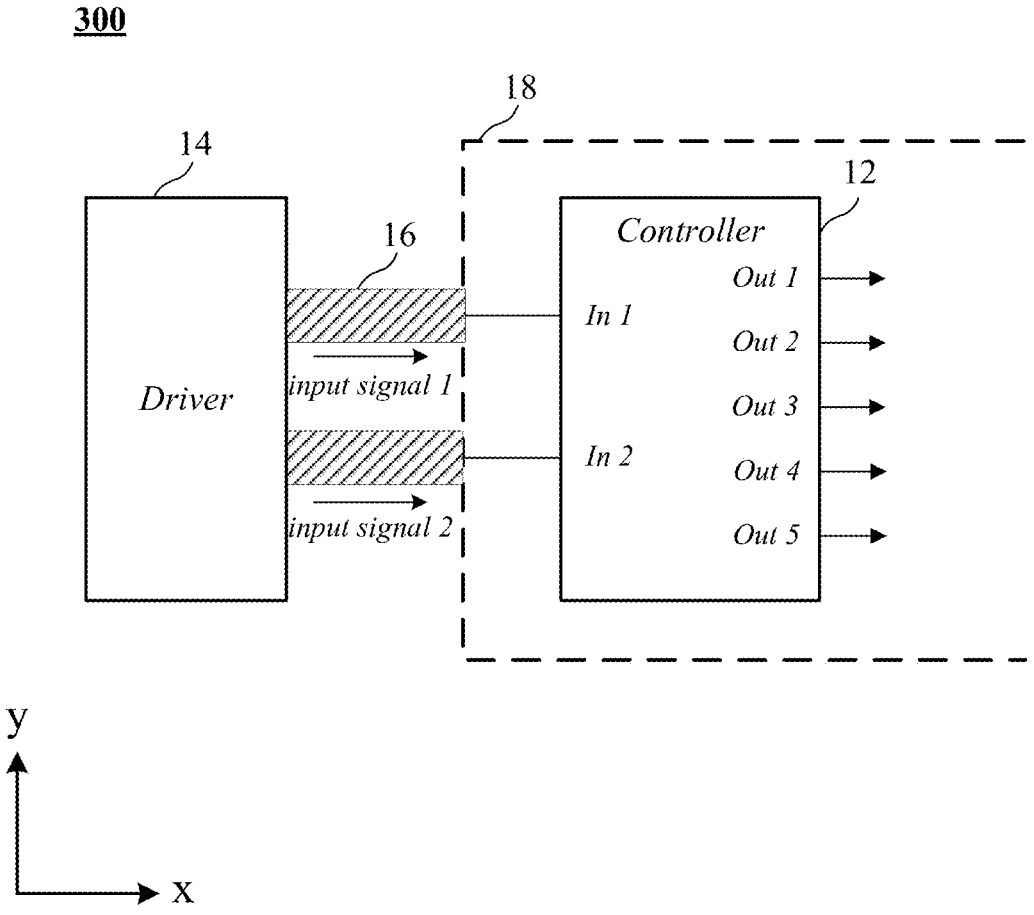
FIG. 2 shows an example map between a voltage of input signal and output gating signal of the controller in the electronic assembly, in accordance with an embodiment.
FIG. 3 is a schematic diagram of an example electronic assembly, in accordance with another embodiment.

FIG. 2 shows an example map between a voltage of input signal and output gating signal of the controller 12 in the electronic assembly 100, in accordance with an embodiment.

In the embodiment, the controller 12 may gate the output channels 1-3 based on a voltage of the input signal. For example, channel 1 is selected such that the load(s) thereon is powered on when the voltage of the input signal is in a range from 1V (volt) to 2V. Similarly, channel 2 is selected such that the load(s) thereon is powered on when the voltage of the input signal is in a range from 2V to 3V, and channel 3 is selected such that the load(s) thereon is powered on when the voltage of the input signal is in a range from 3V to 4V.

Thus, one channel of voltage modulated input signal may be used to gate three channels of outputs. Therefore, the width, in turn a cost of the assembly 100 is reduced.

It is understood that the numbers of input channels (drive wires) and output channels are merely an example, not limitative. A general advantageous is that the number of output channels can be greater than that of the input channels (drive wires). It is also understood that the number of output channels controlled by each input channel (drive wire) may be same or different.

FIG. 3 is a schematic diagram of an example electronic assembly 300, in accordance with another embodiment.

As shown in FIG. 3, the electronic assembly 300 includes a controller 12 and a driver 14. The driver 14 is connected to the controller 12 via two drive wires 16 to provide modulated input signal. The controller 12 has five channels of outputs for example. Each channel of the outputs may be coupled to one or more loads in series, in parallel, or both. Load may be lighting unit such as LED, sound output component, or the like. A total width of the drive wires 16 is less than that of the substrate 18.

The controller 12 is configured to gate five channels of outputs based on the input signal.

FIG. 4 shows an example map between the voltage of input signal and output gating signal of the controller 12 in the electronic assembly 300, in accordance with another embodiment.

As shown in FIG. 4, the controller 12 may gate the output channels 1-5 based on the voltages of the input signal on drive wires 1 and 2. For example, channel 1 is selected such that the load(s) thereon is powered on when the voltage of the input signal on drive wire 1 is in a range from 1V to 2V. Channel 2 is selected such that the load(s) thereon is powered on when the voltage of the input signal on drive wire 1 is in a range from 2V to 3V. Channel 3 is selected such that the load(s) thereon is powered on when the voltage of the input signal on drive wire 1 is in a range from 3V to 4V. Channel 4 is selected such that the load(s) thereon is powered on when the voltage of the input signal on drive wire 2 is in a range from 1V to 2V. Channel 5 is selected such that the load(s) thereon is powered on when the voltage of the input signal on drive wire 2 is in a range from 2V to 3V. Thus, the electronic assembly 300 may control five channels of outputs by only two drive wires.

In the above embodiments, the voltage of each of the input signal(s) is modulated. However, in some embodiments, the controller 12 may gate the output channels based on a current or a combination of the current and voltage of the input signal(s) instead of voltage.

FIG. 5 shows an example map between a combination of the current and voltage of input signal and output gating signal, in accordance with another embodiment.

As shown in FIG. 5, the controller 12 may gate the output channels 1-6 based on the voltages and current of the input signal on one drive wire. For example, channel 1 is selected such that the load(s) thereon is powered on when the voltage of the input signal is in a range from 1V to 2V and the current of the input signal is in a range from 0.5 A to 1 A. Channel 2 is selected such that the load(s) thereon is powered on when the voltage of the input signal is in a range from 1V to 2V and the current of the input signal is in a range from 1 A to 1.5 A. Channel 3 is selected such that the load(s) thereon is powered on when the voltage of the input signal is in a range from 2V to 3V and the current of the input signal is in a range from 0.5 A to 1 A. Channel 4 is selected such that the load(s) thereon is powered on when the voltage of the input signal is in a range from 2V to 3V and the current of the input signal is in a range from 1 A to 1.5 A. Channel 5 is selected such that the load(s) thereon is powered on when the voltage of the input signal is in a range from 3V to 4V and the current of the input signal is in a range from 0.5 A to 1 A. Channel 6 is selected such that the load(s) thereon is powered on when the voltage of the input signal is in a range from 3V to 4V and the current of the input signal is in a range from 1 A to 1.5 A.

With the combination of voltage and current, one channel of voltage and current modulated input signal may be used to control six channels of output signal for example. The width of the substrate 18, such as strip, may be significantly reduced as compared to those that need six channels of input signal with only a few electronic components added, such as the controller 12.

In some embodiment, one channel of input signal may map more than one channel of outputs. The mapped output channels for each channel of the input signal may be partially overlapped. One skilled in the art may arbitrarily design the map as needed.

The function of determining the voltage and/or current of the input signal may be integrated in the controller 12, or be performed by a voltage detection unit and/or current detection unit separated from the controller 12. In this case, such voltage detection unit and/or current detection unit may also be mounted on the substrate 18.

Figure 6:
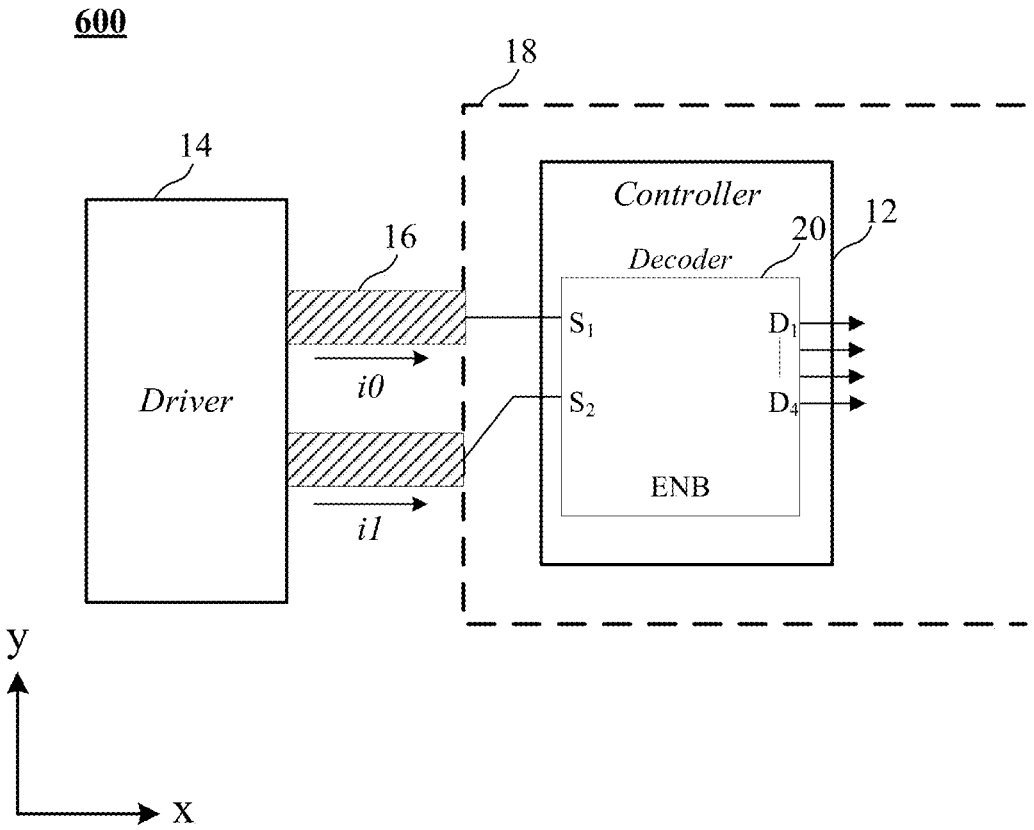
FIG. 6 is a schematic diagram of an example electronic assembly, in accordance with yet another embodiment.

FIG. 6 is a schematic diagram of an example electronic assembly 600, in accordance with yet another embodiment.

The electronic assembly 600 includes a controller 12 and a driver 14. Similarly with the electronic assembly 300, the driver 14 is connected to the controller 12 via two drive wires 16 to provide modulated input signal. The controller 12 has four channels of outputs. Each channel of the outputs may be coupled to one or more loads in series, in parallel, or both. Load may be lighting unit such as LED, sound output component, or the like.

Figure 7:
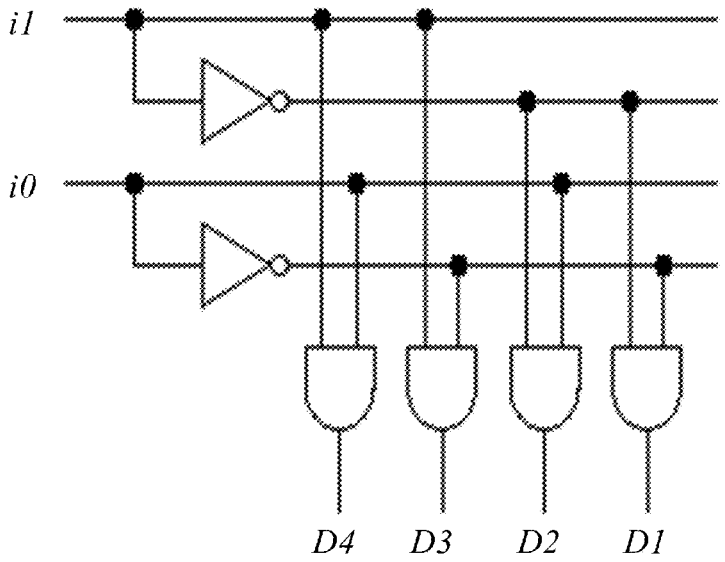
FIG. 7 shows an exemplary circuit structure of a 2-4 decoder.
Figures 8, 9:
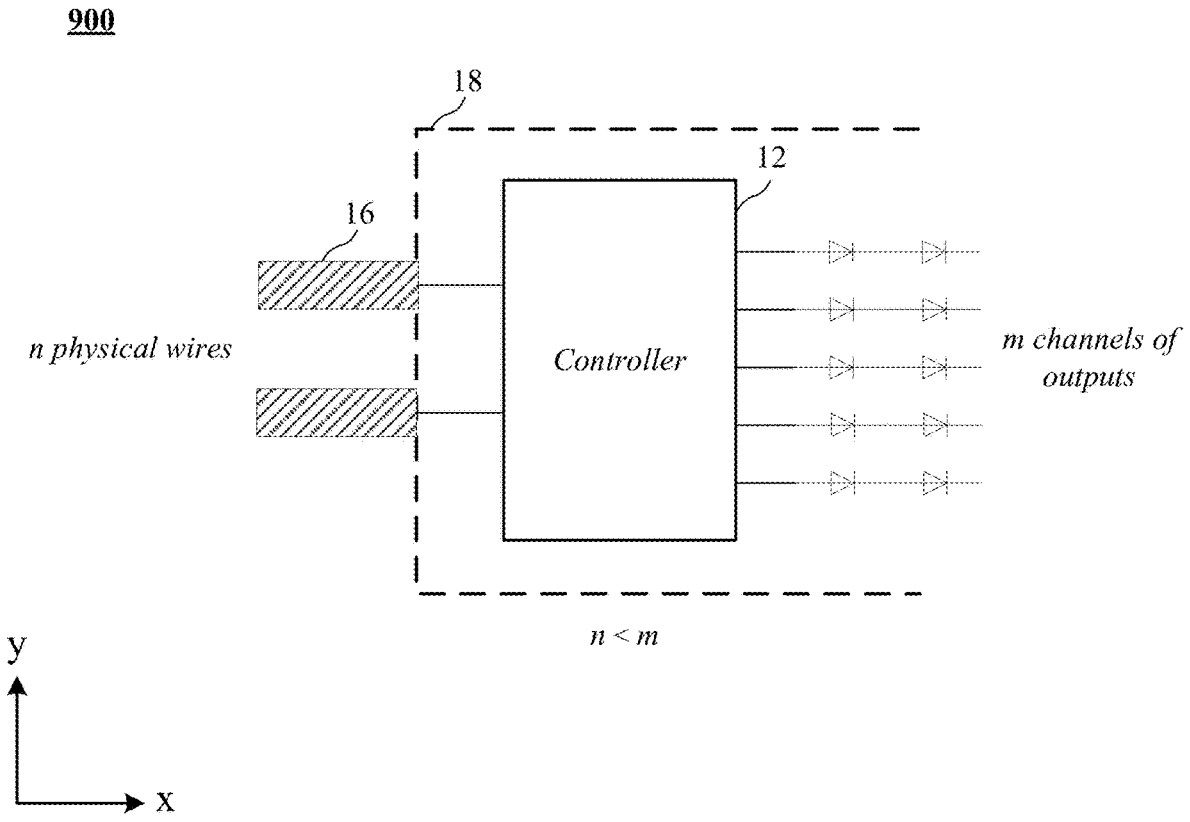
FIG. 8 shows a true table of the 2-4 decoder.
FIG. 9 is a schematic diagram of an example electronic assembly utilized in a lighting device, in accordance with an embodiment.

As shown in FIG. 6, the controller 12 includes a 2-4 decoder 20 with two inputs i0-i1 and four outputs D1-D4. FIG. 7 shows an exemplary circuit structure of the 2-4 decoder 20. FIG. 8 shows a true table of the 2-4 decoder 20. The "1" in the true table may represent a high level and the "0" may represent a low level.

With the usage of decoder 20, the modulation of the input signal may be simplified. It is understood that other type of decoder, such as 3-8 decoder is also applicable. In some embodiments, more than one decoder may be combined to control more output channels.

The electronic assemblies described above may be used in various applications. In most cases, the electronic assemblies may be coupled to a power supply and one or more loads. In a case where the power supply is alternating current, an adapter or a converter may be used to convert the alternating current to direct current. A typical application of the electronic assemblies described herein, namely LED strips, will be discussed below.

For example, FIG. 9 is a schematic diagram of an example electronic assembly 900 utilized in a lighting device such LED strip, in accordance with an embodiment. In such application, the driver 14 described above may be detachable from the lighting assembly 900 and is thus not shown. The lighting assembly 900 may be any one of the lighting assemblies described herein including its conceivable modifications and variations.

The controller 12 may have n inputs connected to n (shown as 2) physical wires and may have m (shown as 5) channels of outputs. Each channel of the outputs may be coupled to one or more loads, e.g. LEDs as shown. Applying the electronic assembly 900 in the lighting device enables the lighting device to gate m channels of LEDs by n ($n<m$) physical wires under a limited width space. Thus, the width, in turn the cost of the lighting device can be significantly reduced.

Exemplary Lighting Devices

Figure 10:
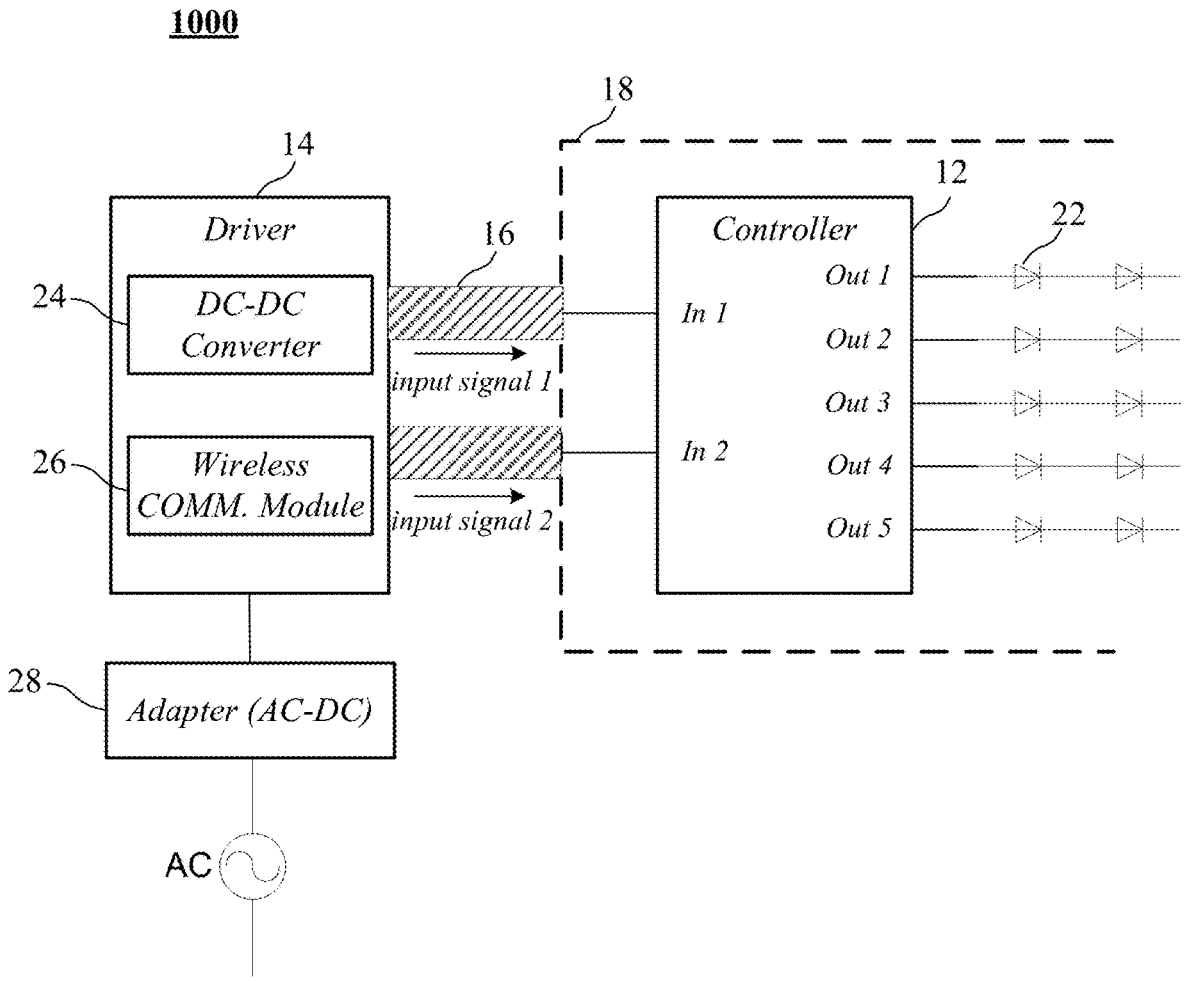
FIG. 10 is a schematic diagram of an example lighting device using the electronic assembly in accordance with the embodiments.
Figure 11:
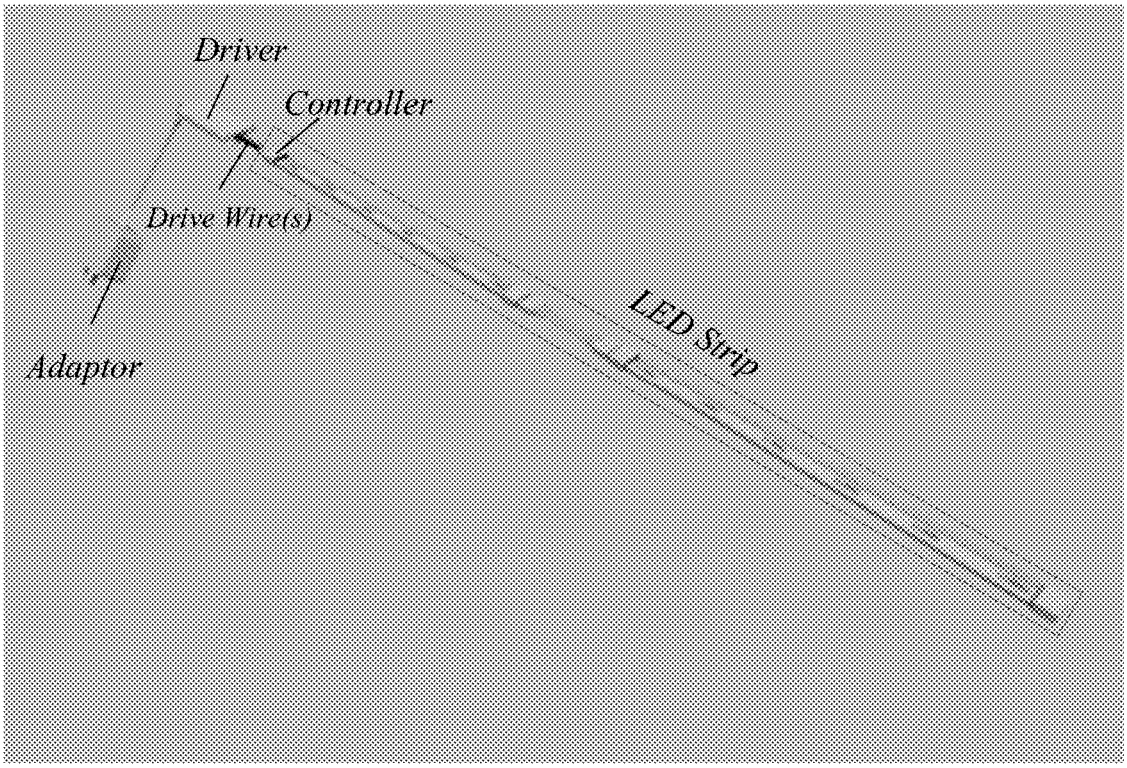
FIG. 11 is a schematic view showing the outline of the lighting device shown in FIG. 9 in accordance with the embodiments.

FIG. 10 is a schematic diagram of an example lighting device 1000 using the electronic assembly in accordance with the embodiments. FIG. 11 is a schematic view showing the outline of the lighting device 1000 shown in FIG. 10 in accordance with the embodiments.

The lighting device 1000 includes a driver 14 and a LED strip. The LED strip may be a flexible circuit board having a strip shape, and include a controller 12 and a plurality of lighting units 22 mounted or fixed thereon. The driver 14 may be detachable from the LED strip. The driver 14 is connected to the controller 12 via e.g. two drive wires 16 to provide modulated input signal. The controller 12 has e.g. five channels of outputs. Each channel of the outputs is coupled to one or more (in FIG. 9, shown as two) lighting units 22. The lighting unit 22 may be LED. It is understood that other additional electronics, such as resistors, may also be provided on the LED strip, not shown here for ease of illustration.

An optional adapter 28 is coupled to a power supply, such as AC supply, and is configured to convert alternating current (e.g. 120V ac) to direct current (e.g. 12V dc). The direct current is then transmitted to the driver 14. It is understood that the adapter 28 can be omitted when the power supply is DC supply.

The driver 14 may include a DC-DC converter 24 to perform the modulation described above. In some embodiments, the DC-DC converter 24 may operate in a manner of pulse width modulation or pulse frequency modulation or a combination thereof.

The driver 14 may further include a wireless communication module 26 to receive control signal from communication network. In some embodiments, the wireless communication module 26 may use any number of frequencies and protocols, such as 2.4 gigahertz (GHz) transmissions under the IEEE 802.15.4 standard, using the Bluetooth® low energy (BLE) standard, as defined by the Bluetooth® Special Interest Group, or the ZigBee® standard, among others. The control signal may cause the driver 14 to perform proper modulation.

With the implementations described above, m channels of loads (such as LEDs) may be controlled through n wires where n is less than m. This may significantly reduce the width of the electronic assembly such as light strip, namely reduce the material costs by adding only a few electronic components.

It is to be understood that specifics in the aforementioned examples may be used anywhere in one or more embodiments.

The person skilled in the art shall understand that many modifications and variations may be made to the present invention. Therefore, it should be recognized that the intention of the claims is to cover all these modifications and variations within the real concept and range of the present invention.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An electronic assembly with m channels of outputs, comprising:

a controller configured to gate the m channels of outputs thereof; and a driver configured to provide n input channels of modulated input signal to the controller via n wires to control the m output channels, wherein the controller is configured to gate the m channels of outputs based on a characteristic of the n channels of modulated input signal, wherein the characteristics are selected from a group including at least one of voltage and current, and wherein n is less than m.

2. The electronic assembly of claim 1, wherein them channels of outputs of the controller are coupled to a plurality of loads.

3. The electronic assembly of claim 2, wherein the electronic assembly is included in a lighting device and at least one of the plurality of loads is LED.

4. The electronic assembly of claim 2, wherein the controller and the plurality of loads are mounted on a flexible substrate.

5. The electronic assembly of claim 4, wherein the controller is mounted on one end of the substrate.

6. The electronic assembly of claim 5, wherein the n wires are aligned along a width direction of the substrate at the end thereof.

7. The electronic assembly of claim 1, wherein the driver comprises a converter configured to modulate input DC signal to generate the n channels of modulated input signal.

8. The electronic assembly of claim 1, wherein the driver further comprises a communication module configured to receive control signal.

9. The electronic assembly of claim 8, wherein the n channels of modulated input signal is generated based on the control signal.

10. The electronic assembly of claim 1, wherein the characteristic is voltage.

11. The electronic assembly of claim 1, wherein the characteristic is a combination of voltage and current.

12. The electronic assembly of claim 1, wherein the controller comprises at least one decoder to gate the m channels of outputs based on the n channels of modulated input signal.

13. The electronic assembly of claim 7, wherein the converter is DC-DC converter.

14. The electronic assembly of claim 2, wherein each channel of the m channels of outputs is coupled to at least one of the plurality of loads.

15. The electronic assembly of claim 8, wherein the communication module is a wireless communication module.

16. The electronic assembly of claim 15, wherein the control signal is received from communication network via the wireless communication module.

17. The electronic assembly of claim 7, further comprising an adapter configured to convert AC supply to the input DC signal.

18. A lighting device, comprising:

a substrate;

a controller mounted on one end of the substrate, including m channels of outputs;

a driver configured to provide n input channels of modulated input signal to the controller via n wires to control the m output channels, comprising a communication module configured to receive control signal, wherein the driver is configured to generate the n channels of modulated signal based on the control signal; and a plurality of lighting units coupled to the m channels of outputs of the controller, wherein n is less than m, wherein the n wires are aligned along a width direction of the substrate at the end of the substrate, wherein the controller is configured to gate the m channels of outputs based on a correspondence between the at least one of the characteristics of the n channels of modulated signal and m channels of output signal, and wherein the characteristics are selected from a group consists of voltage, current and a combination thereof.

19. A lighting device, comprising:

a substrate;

a controller mounted on one end of the substrate, including m channels of outputs;

a driver configured to provide n input channels of modulated input signal to the controller via n wires to control the m output channels, comprising a communication module configured to receive control signal, wherein the driver is configured to generate the n input channels of modulated input signal based on the control signal; and a plurality of lighting units coupled to the m channels of outputs of the controller, wherein the controller further comprises at least one decoder to gate the m channels of outputs based on the n channels of modulated signal, wherein each input channel controls m output channels, wherein the controller is configured to gate the m channels of outputs based on a characteristic of the n channels of modulated input signal, wherein the characteristics are selected from a group including at least one of voltage and current, wherein n is less than m, and wherein the n wires are aligned along a width direction of the substrate at the end of the substrate.

20. The electronic assembly of claim 7, wherein the driver further comprises a communication module configured to receive control signal.

21. The electronic assembly of claim 20, wherein the n channels of modulated signal is generated based on the control signal.

22. The electronic assembly of claim 21, wherein the characteristic is voltage.

23. The electronic assembly of claim 22, wherein the characteristic is a combination of voltage and current.

24. The electronic assembly of claim 20, wherein the communication module is a wireless communication module.

25. The electronic assembly of claim 24, wherein the control signal is received from communication network via the wireless communication module.

* * * * *